United States Patent [19]

Crooks

[11] Patent Number: 4,920,301

[45] Date of Patent: Apr. 24, 1990

[54] CAPACITOR DISCHARGE STROBE LIGHT

[76] Inventor: James M. Crooks, P.O Box 131, Verona, Wis. 53593

[21] Appl. No.: 271,500

[22] Filed: Nov. 15, 1988

Related U.S. Application Data

[63] Continuation-in-part of Ser. No. 927,337, Nov. 6, 1986, abandoned.

[51] Int. Cl.[5] ..... F21Q 3/00; H05B 41/30; H05B 41/34

[52] U.S. Cl. ..... 315/241 S; 315/200 A; 315/227 R; 315/240; 315/324; 362/227; 362/240

[58] Field of Search ..... 315/241 S, 241 R, 241 P, 315/227, 240, 289, 200 A, 324; 362/227, 240

[56] References Cited

U.S. PATENT DOCUMENTS

| | | | |
|---|---|---|---|
| 3,953,763 | 4/1976 | Herrick | 315/241 S X |
| 4,139,805 | 2/1977 | Cosco et al. | 315/241 R |
| 4,185,232 | 1/1980 | Ingalls et al. | 315/241 R |
| 4,580,201 | 4/1986 | Williams | 362/227 |
| 4,613,797 | 9/1986 | Eggers et al. | 315/241 R |

*Primary Examiner*—James J. Groody
*Assistant Examiner*—Mark R. Powell
*Attorney, Agent, or Firm*—Haight & Hofeldt

[57] ABSTRACT

A compact capacitor discharge and strobe light beacon system is disclosed which is designed to be used in a conventional incandescent aircraft warning light fixture. The system comprises: a step-up transformer; a pulse shaping network for rectifying the output of the transformer to pulsating DC, capacitor means connected to the output of the pulse shaping network, a choke, at least two xenon lamps with terminals and connected across the terminals of an energy storage capacitor through the choke, and a switch which fires the lamps.

25 Claims, 3 Drawing Sheets

FIG. 2
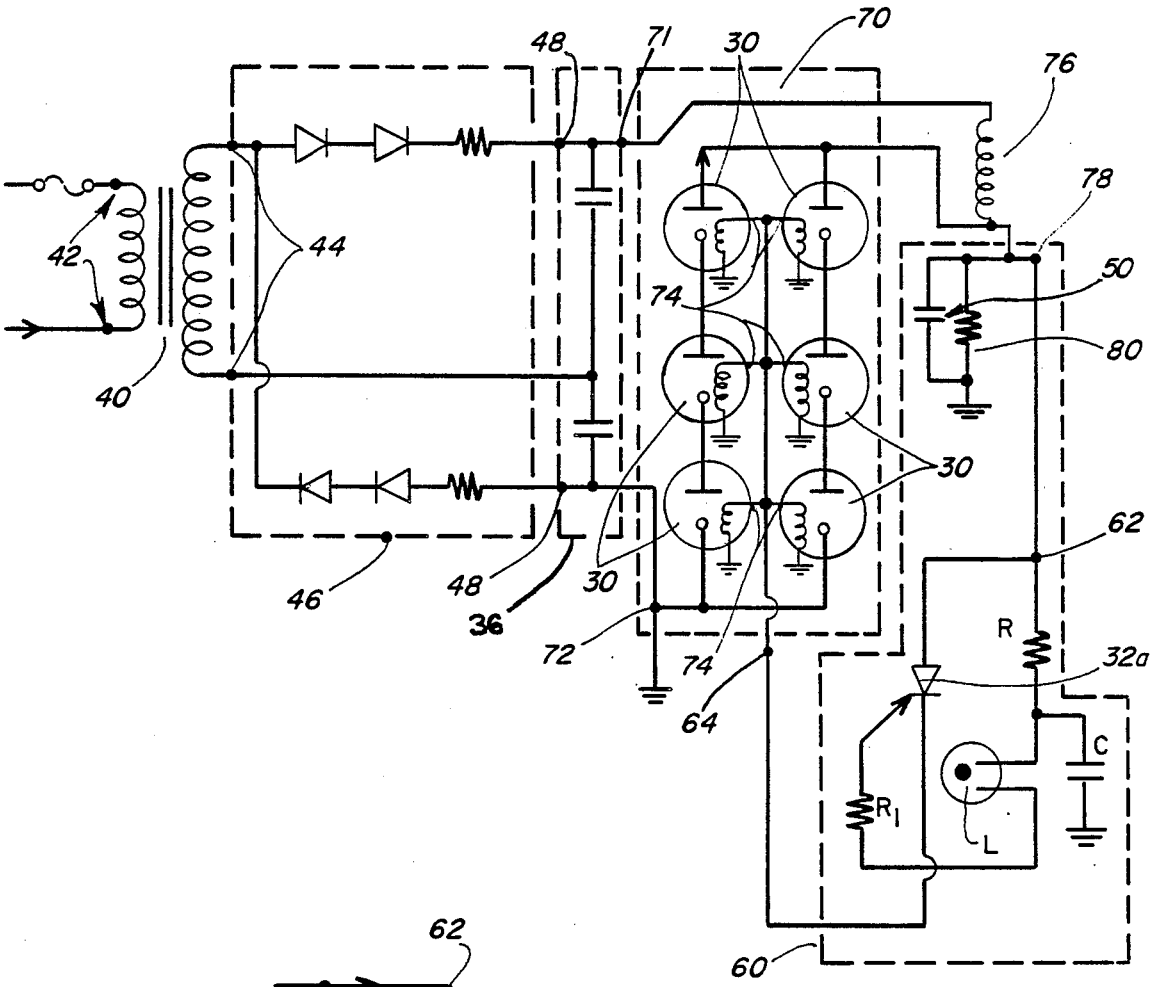
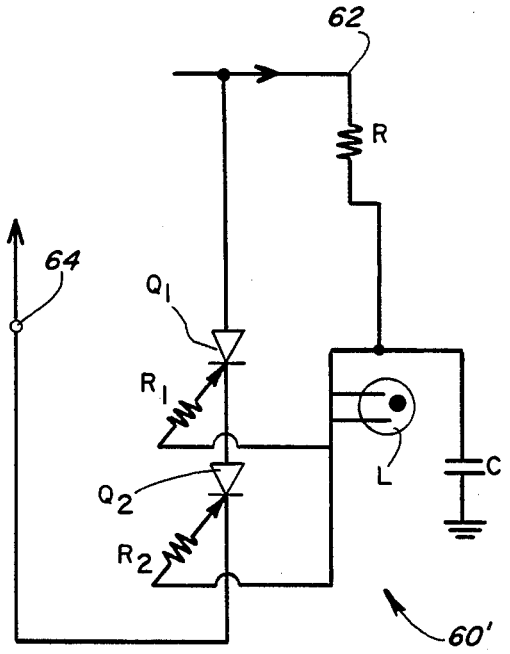
FIG. 2A
FIG. 3
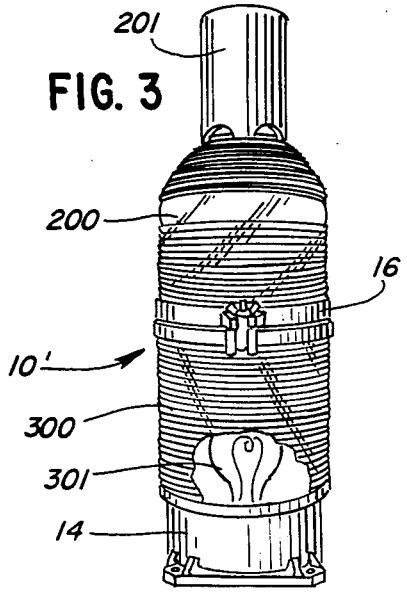

CAPACITOR DISCHARGE STROBE LIGHT

This application is a continuation-in-part of U.S. patent application Ser. No. 06/927,377, filed on November 6, 1986, now abandoned.

FIELD OF THE INVENTION

This invention relates to the general subject matter of lights and lighting systems, and, in particular, to the subject of strobe lights and flashing beacons, especially those used to warn aircraft of an obstacle.

BACKGROUND OF THE INVENTION

To assure aeronautical conspicuity, any temporary or permanent object, or portion thereof, that exceeds an overall height of 200 feet AGL (above ground level), including all appurtenances, such as lights, rods, antennas, towers, etc., or any object that exceeds any obstruction standard contained in FAR (Federal Aviation Regulations), Part 77, subpart C, should be marked and/or lighted in accordance with described standards. Normal outside or commercial lighting is not sufficient.

Marking warns pilots on a potential collision course with a structure of its presence during daylight hours. This may be accomplished by coloring the structure or indicating its presence by the use of suitable markers, such as flags or spheres.

Lighting is used to warn pilots on a potential collision course with structure during the day or the night. Red obstruction lights are used during the hours of darkness and periods of limited daytime illuminance and/or reduced meteorological visibility. Flashing aviation red beacons and steady burning aviation red lights are normally used during the night. Flashing high intensity white obstruction lights are mostly used during daytime, with automatically selected reduced intensity for twilight and nighttime operations. Flashing medium intensity white obstruction lights, with automatically selected reduced intensity for night operation, are also used. A combination of flashing aviation red beacons and steady burning aviation red lights for nighttime and flashing high or medium intensity white lights may be used for daytime. Dual obstruction lighting systems may not be recommended when an aeronautical study determines that if it is not feasible to operate a high intensity or medium intensity white lighting system at night. Current details regarding marking and lighting systems are contained in FAA Advisory Circular 70/7460-1G. Light systems should conform with the provisions of AC 150/5345-43, "Specifications for Obstructional Lighting Equipment".

There are advantages in using flashing white obstruction lights. First of all, a flashing light attracts attention. Secondly, it may be more visible during certain overcast conditions. From a practical point-of-view, painting tall structures to provide a warning by marking is not only expensive, but also hazardous.

There is also an incentive under current federal regulations to use flashing white obstruction lights. For example, when high intensity flashing white lights are operated during daytime and twilight, other methods of marking may be omitted. Moreover, when flashing medium intensity white obstruction lights are used on structures 500 feet AGL or less in height, other methods of marking and lighting the structure may be omitted; when operated 24 hours a day, other methods of marking and lighting may be omitted. High intensity flashing white lighting systems should have an intensity of: 200,000 candela during the day mode; 20,000 candela during the twilight mode; and 2,000 candela during the night mode. Medium intensity flashing white lighting systems lights should have an effective intensity of no less than 20,000 candela for the day and twilight modes, and approximately 2,000 candela for the night mode.

Because of the advantages of using flashing white obstructions lights, it would be preferable to convert a red obstruction light system to a flashing white obstruction light system. Although, strobe light devices and the methods used for producing a strobe light using the discharge of capacitors are known to exist, they do not, for the most part, use an existing lighting fixture. For example, there is the STROBEGUARD beacon by EG&G and the ELECTROFLASH beacon by Enterprises Inc. which use a new light fixture (See AC 70/7460-1G, Appendix 1, beacon L-866).

Strobe lights are the subject of certain patents (See U.S. Pat. Nos. 4,139,805; 4,185,232; 3,953,763; 4,580,201; and 4,613,797 for some examples). It is believed that the prior art does not disclose or suggest a strobe light system which can be used with an existing incandescent tower light fixture in such a manner as to meet the requirements of the Federal Aviation Administration.

Preferably, if one were to convert or retrofit a red obstruction light system to a flashing white obstruction system, the conversion should use as much of the existing wiring as possible, especially those parts located high on the obstacle or tower structure. Moreover, it would be desirable to use the existing lens and base of the incandescent light fixture. Typically, such light fixtures use an industry or code standard known as a 300 MM code beacon incandescent tower light fixture; such a fixture has a 9.75 inch, 4-hole, metal base which fits on a standard beacon mounting plate on the obstacle or tower structure. 120 V AC, 50/60 hertz, single phase electrical power is supplied to a socket and/or terminal board in the base of the fixture generally from a waterproof junction box mounted near the base of the light fixture. Hingedly connected to the base is a clear glass Fresnel lens. (See AC 70/7460-1G Appendix 1, beacon L-866).

SUMMARY OF THE INVENTION

An object, advantage and feature of the invention is to provide a novel retrofitable capacitor discharge strobe light which is sufficient to meet the requirements of Federal Aviation Administration Bulletin Number AC 70/7460 (Aviation Marking and Lighting).

Another object of the invention is to provide a ring of xenon lamps wired and controlled to flash simultaneously and redundantly to produce a light output substantially in excess of 20,000 candela during daylight and 2,000 candela during the night.

A further object of the invention is to provide a light system which is configured and packaged in a way that it may be easily carried and installed by one person in an existing standard (e.g., 300 MM code) beacon incandescent tower light fixture, thus greatly reducing the cost of the lighting system, the cost of its installation, and its maintenance.

In one embodiment of the invention, the strobe light beacon system comprises: HVDC means for producing a high voltage from the AC power supply to the base of the preexisting incandescent tower light fixture; energy storage means for receiving the high voltage through a choke and capacitively storing energy therein; means for producing light from at least two discharge lamps which are connected to be operated redundantly and simultaneously in response to a triggering signal; means for operating a switch to apply the triggering signal to the lamps after AC power has been applied to the charge the energy storage means for a predetermined time interval; and mounting means carried by the base of the incandescent light fixture and fitting within a Fresnel lens for mounting the energy storage means and the lamps.

In one embodiment of the invention, the system has a daylight mode and a night mode, a bank of capacitors for storing energy for each mode and appropriate switching, and means for biasing a bank of electrolytic capacitors that are not in use to prolong their life. In one embodiment of the invention xenon discharge lamps are used which are positioned along a ring so as to be axially offset from the axis of the Fresnel lens.

By using the existing incandescent light fixture and much of the associated wiring and power supply cables, the cost of installation is minimized. Moreover, by mounting the components in a small compact structure, the installation can largely be made using only one technician and with minimum interference or tower down time.

Numerous other advantages and features of the present invention will become readily apparent from the following detailed description of the invention, the embodiments described therein, from the claims, and from the accompanying drawings.

BRIEF DESCRIPTION OF THE DRAWINGS

FIG. 2 is a schematic diagram of one embodiment of the capacitive discharge and strobe light beacon system;

FIG. 2A is a schematic circuit showing two SCR's for a control circuit of FIG. 2.

FIG. 3 is a pictorial representation of another standard incandescent tower light fixture which houses a capacitive discharge strobe light beacon that is the subject of the present invention.

DESCRIPTION OF THE PREFERRED EMBODIMENT

Figure 1:
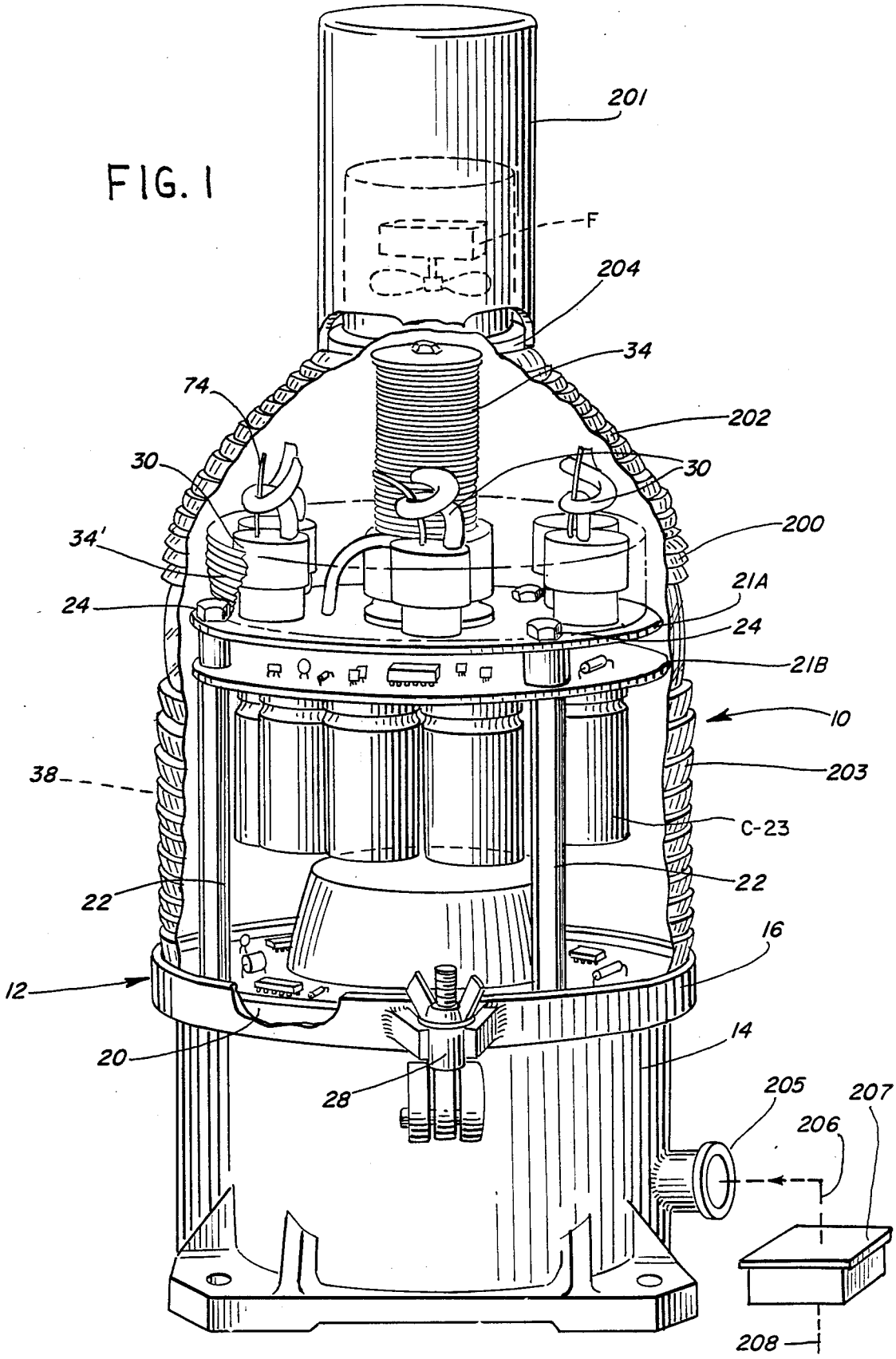
FIG. 1 is a perspective view, partially in section, of a standard incandescent tower light fixture which houses the capacitive discharge and strobe light beacon system of the present invention.

While this invention is susceptible of embodiment in many different forms, there is shown in the drawings and will herein be described in detail several specific embodiments of the invention. It should be understood, however, that the present disclosure is to be considered as an exemplification of the principles of the invention and is not intended to limit the invention to the specific embodiments illustrated.

Referring now to the drawings, there is shown in FIG. 1 a capacitor discharge and strobe light beacon system 10 in an assembly 12. The compact system is lightweight (e.g., 15 pounds) and small in size (12 inches high and 8 inches in diameter). The assembly 12 comprises a lower housing or base 14, a lower hinge ring 16 which pivotally connected by a hinge 18 to the lower housing, and a lens assembly 200. The lens assembly 200 comprises an outer cap 201, a clear dome lens 202, and a clear cylindrical Fresnel lens 203. A top flange 204 uses gaskets to sealingly join the dome lens 202 to the Fresnel lens 203. The Fresnel lens 203 is sealingly joined to the hinge ring 16 by another gasket. An internal rod structure (not shown) mechanically holds the two lenses 202 and 203 together and anchors the outer cap 201 and top flange 204 to the hinge ring 16. A wing nut latch 28 holds the lens assembly 200 atop the hinge ring 16. A water tight connector 205 is used to join conduit 206 to a nearby junction box 207. The junction box provides a convenient location for joining a source 208 (typically, 120 V AC, 60 cycle) of electrical power to a terminal block and/or lamp socket attached base 14 (and to the top flange 204).

Housed within the assembly 12 is a mounting means for carrying therein components of the electrical and electronic systems which produce a flashing light. The mounting means comprises: a lower mounting plate 20 which is joined to, by spaced anchor bolts 22 and attaching nuts 24, two upper mounting plates 21A and 21B. The upper mounting plates 21A and 21B and the lower mounting plate 20 supports, or comprises a support for, circuit boards which carry many of the circuit components shown in FIGS. 2 and 4. In particular, the upper mounting plate 21A supports at least two xenon lamps or strobe lamps 30, SCR's 32 (see FIG. 2), a lamp discharge coil or flash choke 34 (See. FIG. 2) and capacitor energy storage means.

FIG. 2 illustrates one embodiment of many of the principal components of the invention. Power is produced from a step-up transformer 40 having two input terminals 42 for connection to a supply source of AC power in the base 14 of the incandescent light fixture. The transformer 40 takes 120 V AC and supplies an output voltage of approximately 800 V AC to two output terminals 44. A pulse shaping network 46 is connected to the output terminals 44 of the transformer 40 for rectifying the output of the transformer to pulsating DC. Connected to output terminals 48 of the pulse shaping network 46 are capacitors 36 which are charged to approximately 900 V DC.

The output 71 of the pulse shaping network 46 and capacitors 36 is joined by means of a flash choke 76 to a lamp load 70, and a trigger or timing oscillator circuit 60. The timing oscillator circuit 60 includes an input terminal 78, and an output terminal 64. The timing oscillator circuit 60 has component values which are selected to cause the lamps 30 to strobe simultaneously in a predetermined and regular timed sequence.

Here, a lamp load 70 is formed from at least a twin bank of three series connected xenon lamps 30 which are arranged in a ring (see FIG. 1) and which are electrically connected to the energy storage capacitors 36 through the flash choke 76. Each of the xenon lamps 30 has triggering electrode 74. The flash choke 76 is connected to the energy storage means 36 and the input to the timing oscillator 60 by an input terminal 78. There a resistor 80 is connected across a capacitor 50 to discharge the capacitor between trigger pulses. The purpose of the capacitor 50 is to store energy to develop the lamp trigger pulse.

The ring of xenon lamps 30 (see FIG. 1) are arranged axially offset from the longitudinal axis of the Fresnel lens 203. The lamps 30 are wired and controlled to flash simultaneously to produce a strobing or flashing white light output substantially in excess of 20,000 candela at the exterior of the lens assembly 200. Here, two banks of three series connected xenon lamps 30 operate simultaneously, thus providing a certain amount of redundancy. The bank of xenon lamps 30 may be arranged in opposing relation or in an interdigital array. The components of the timing oscillator 60 are adjusted to cause the xenon lamps 30 to fire forty times per minute. The flash choke 76 and the capacitor energy storage means 36 are functionally in series with the anode of the xenon lamps 30 when the lamps are fired, whereby the choke 76 controls the rate of discharge of the large energy storage capacitors. This arrangement protects the energy storage capacitors 36 and increases the life of the xenon lamps 30. By arranging the six lamps in two banks of three series connected lamps, the voltage across each lamp is limited to approximately 300 V DC; this also increases the life of each lamp.

The timing oscillator 60 comprises a solid-state switch or a SCR 32*a* which is gated by an RC circuit and neon lamp L. When terminal 78 has a voltage applied to it, timing capacitor C changes through a resistor R. The values of R and C are chosen such that there is sufficient time for the energy storage capacitors to charge high enough to be discharged. When the timing capacitor C is charged high enough, the neon lamp L can discharge. This supplies a voltage to the gate of the SCR 32*a* which causes it to conduct, thereby triggering the lamps 30 and discharging the energy storage means 36.

In summary, a 120 V AC source (i.e., through junction box 207, conduit 206, and base 14) powers a transformer 40 which steps up the voltage to 800 V. This voltage is rectified into pulsating DC and then applied to storage capacitors 36 which charge to 900 V. A flash choke 76 is connected in series between the xenon lamps 30 and a trigger capacitor 50. The timing oscillator circuit 60 controls the triggering electrode of the xenon lamps 30. The timing oscillator 60 is energized to cause the xenon lamps 30 to conduct or fire forty times per minute.

FIG. 3 illustrates another housing arrangement 10'. Here a strobe light is combined with a red warning light. Here, the base 14 carries a red light emitting lens 300 and a white light Fresnel lens 200. This structure 10' is approximately 38 inches in length, while the structure 10 in FIG. is about 25 inches in length. Here, an incandescent bulb 301 is carried by the base 14, while the hinge ring 16 carries the mounting means for the capacitive discharge and strobe light system. In some geographical and regulatory situations, a dual lighting system may be preferred.

Figure 4:
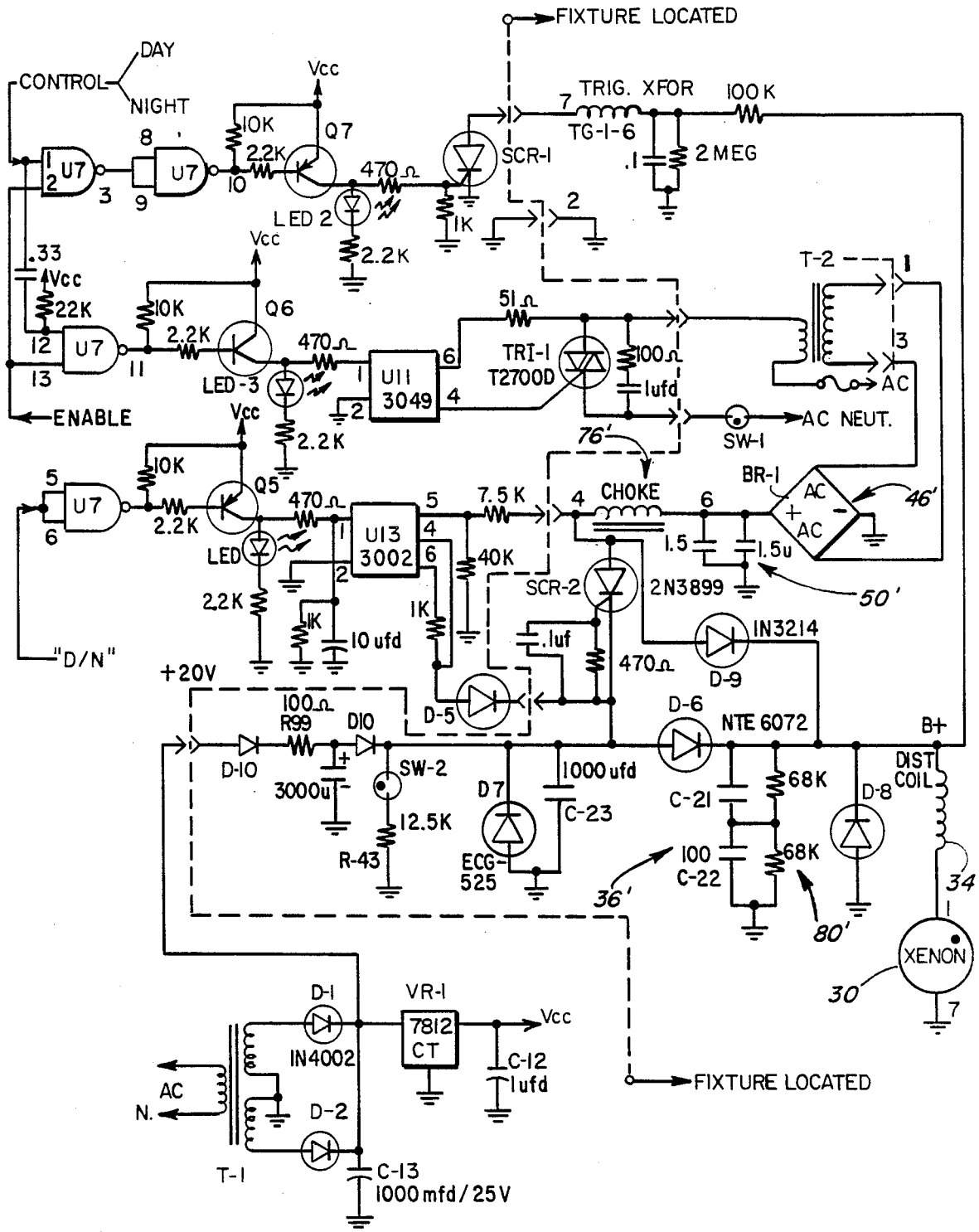
FIG. 4 is a schematic diagram of another embodiment of the capacitive discharge and strobe light beacon system.

FIG. 4 illustrates another embodiment of the present invention. Beginning with the high voltage step-up transformer T-2, the amount of energy stored in the capacitors is controlled by the amount of time the high voltage transformer is turned "on". Here, the high voltage transformer T-2 is turned "on" through a triac TRI-1. The triac TRI-1 functions as an anti-neoning circuit for the xenon lamps 30; it eliminates the disadvantage of neoning or lamp "hang-up" due to subsequent recharging of the energy storage capacitors in preparation for the next controlled flash. Also by reducing the high voltage from 1400 V DC to approximately 450 V DC, the "corona" effect on the electronics and printed circuit boards is eliminated. However, larger capacitor banks are needed.

This embodiment has a day mode and a night mode of operation. There are two banks of energy storage capacitors C-21 in series with C-22, and C-23. In the day mode, the high voltage transformer T-2 is pulsed by the triac TRI-1 for about one second, which provides enough energy to both banks of capacitors to discharge them through the xenon lamps 30 and generate about 20,000 candela of light. In the night mode of operation, the high voltage transformer T-2 is pulsed for a shorter period of time sufficient to provide enough energy to one bank of capacitors, C-21 in series with C-22, to discharge them through xenon lamps 30 and provide about 2,000 candela of light. In the night mode, capacitor energy storage bank C-23 is switched out through a solid state switch SCR-2 which leaves the capacitor energy storage bank formed by capacitors C-21 and C-22 providing energy to the xenon lamps 30. High voltage diodes D-7 and D-8 (ECG-525) are high voltage diodes which are positioned across the capacitor banks to limit the reverse voltage and protect the capacitors.

When sufficient high voltage (approximately 450 V DC) is impressed across the xenon lamps 30 and the proper time interval is achieved, a third solid-state switch SCR-1 is fired from a digital timing circuit (e.g., U7 and Q7) to impress a pulse across each lamp trigger transformers (i.e., one located at the base of each xenon lamp), which causes the gas in the tubes to ionize and produce a brilliant flash. A discharge coil 34 in series with the bank of xenon lamps, controls the width of the flash, thus, the brilliance of the light.

This embodiment uses six plug-in octal base xenon lamps 30 in a six inch diameter circle. Full intensity is preferably achieved with as few as one lamp. By arranging the lamps in a ring, a larger "point of light" is provided; this helps to decrease the possibility of part of the obstruction (e.g., a tower leg) masking the warning light.

It should be noted that, in the case of the arrangement illustrated in FIG. 1, the discharge coil 34 is located along the longitudinal axis of the Fresnel lens 203, such that the xenon lamps 30 are located between the discharge coil and the Fresnel lens. As such, the discharge coil 34 shields part of the Fresnel lens 34 from any particular xenon lamp 30; therefore, the efficiency of the lamps 30 and Fresnel lens 203 system is somewhat diminished. Efficiency can be increased by locating the discharge coil 34' (See FIG. 1) below the lamps 30 and between the Fresnel lens 203 and the lamps. When this is done, the discharge coil is shorter in height and has larger diameter.

The proper timing pulses are provided by appropriate digital circuitry. In one particular embodiment, an external synchronization pulse (i.e., sync pulse) is provided from the 60 cycle AC line. Should the external sync pulses be lost, the circuitry uses an internal clock. When only one strobe light is located on a tower or obstruction, it is preferable that an internal clock be used (e.g., spurious 60 cycle signals are avoided).

Transformer T-1 is a low voltage transformer used to supply approximately 20 V AC to two rectifiers D-1 and D-2. The rectifiers provide approximately 20 V to 22 V DC to a 12 V DC voltage rectifier VR-1. A capacitor C-13, at the input of the voltage regulator VR-1, smooths out the ripple in the DC. A capacitor C-12, at the output of the regulator VR-1, prevents oscillations in the regulator. The 12 V regulated DC voltage at the output of regulator VR-1 is the voltage $V_{CC}$ used throughout the CMOS control circuitry.

To control the daytime and night time mode of operation, a photocell (e.g., cadmium sulfide) may be used as the principal sensor. The photocell is mounted in a position to scan the northern hemisphere. The output of the photocell is fed via a pair of wires to a suitable control board. As the light on the photocell increases, its resistance decreases. This effect may be used to operate a transistor circuit to provide a signal "D/N" to operate a solid-state relay U13 which controls energy bank switch SCR-2. The same sensor and output can be used to control the flashing rate of the lamps.

An LED in the collector of transistor Q5 is lighted when all the capacitor banks C-23 are switched "on" (i.e., during the day mode of operation using switch by SCR-2). Another LED at the collector of transistor Q6 provides an indication when the high voltage transformer T-2 is turned "on". Still another LED at the collector of transistor Q7 indicates when a sync pulse is provided to switch SCR-1 to fire the xenon lamps.

Safety is provided by mercury switches. One mercury switch SW-1, located at the base of the strobe assembly, causes AC power to be disconnected when the strobe unit is tilted about 10 degrees from level upright. Another mercury switch SW-2 causes a bleeder resistor R-43 to be switched across the capacitor bank C-23 when the strobe is tilted. This discharges the high voltage below 50 V in less than 30 seconds. This protects the technician from electrical shock. Thus, the strobe unit must be in an upright position to operate correctly.

High voltage diode D-6 isolates the two capacitor banks C-23 and C-21 in series with C-22. When switch SCR-2 is "off", there is a back EMF across D-6 (i.e., approximately 0.7 volts). This voltage is impressed across C-23 which would ordinarily result in heating and venting of the electrolytic capacitors forming the energy storage bank. Electrolytic capacitors are inherently polarized "plus" and "minus". Thus, when even a small voltage is developed across them, in a reverse direction, gas is generated and the possibility of an explosion exists. To prevent this and increase the life of the electrolytic capacitors, a biasing circuit is provided. A 20 V DC signal is taken from output of rectifiers D-1 and D-2 through isolation diodes D-10 and a 100 ohm resistor R-99. This results in approximately 5 V DC signal being applied to the isolated capacitor bank C-23, thereby preventing a back EMF.

Toroidal step-up or high voltage transformers and chokes are, for the most part, more efficient than conventional transformer cores. However, because of their size they may not be easily fit into the body of the light fixture. Thus, in some situations, it may be necessary to mount them in an enlarged junction box 207.

There are several special features of the invention that distinguish it from lighting systems made by others: (1) multiple/redundant lamps; (2) axial offset lamps; (3) lower voltage lamps (450 V DC vs. 1425 or 1050 V DC); (4) longer lens life (glass vs. plastic); (5) major tower wiring is used without replacement; (6) compatible with dual lighting systems and fixtures; and (7) is small in size and made from light weight components (i.e., about 15 pounds).

The foregoing is considered as illustrative only of the principles of the invention. Further, since numerous modifications and changes will readily occur to those skilled in the art, it is not desired to limit the invention to the exact construction and operation shown and described. For example, the trigger pulse or ionizing pulse may be controlled by two silicon control rectifiers Q1 and Q2 connected in series to provide sufficient voltage protection to assure a high degree of reliability to the system; this is shown in FIG. 2A. In addition, the lens cap 201 may be used to house a small fan "F" to cool the electronic components, especially on hot days. Accordingly, all suitable modifications, and equivalents resorted to, are deemed to fall within the scope of the claims which follow.

I claim:

1. A capacitor discharge and strobe light beacon system for an incandescent tower light fixture of the type having a cylindrical open ended base to which AC power is supplied and a generally cylindrical high quality glass Fresnel lens which is removably attached to close the open end of the base, comprising:

HVDC means for producing a rectified high voltage, said HVDC means having input terminals for receiving the AC power supplied to the base of the light fixture and having HV output terminals for an output voltage;

first energy storage means for receiving high voltage from said HVDC means and capacitively storing energy therein across two terminals of which one is connected to one end of choke means;

load means for producing light from at least two discharge lamps which are connected to be operated redundantly and simultaneously, each lamp having an anode terminal connected to the other end of said choke means, having a cathode terminal connected to the other of said two terminals of said energy storage means, and having triggering means for discharging said energy storage means through said lamps upon receiving a triggering signal;

circuit control means for operating a switch to apply said triggering signal to said lamps from said energy storage means after AC power has been applied to said HVDC means for a predetermined time interval; and mounting means, carried by the base of the incandescent light fixture and fitting within the Fresnel lens, for mounting said energy storage means and said lamps, said lamps being removably located at a spaced distance from the longitudinal axis of the Fresnel lens.

2. The system of claim 1, wherein the incandescent tower light fixture is a standard 300 mm code fixture.

3. The system of claim 1, wherein said triggering signal is supplied to said lamps from a triggering transformer carried by said mounting means.

4. The system of claim 1, wherein said switch is carried by said mounting means.

5. The system of claim 1, wherein AC power is supplied to the base through an external junction box located near the base, and wherein said HVDC means is located in said box.

6. The system of claim 5, wherein said choke means comprises a choke located in said box and a discharge coil which is carried by said mounting means.

7. The system of claim 1, wherein high voltage is supplied to said lamps from said energy storage means through a discharge coil which is carried by said mounting means.

8. The system of claim 7, wherein said discharge coil is located on said longitudinal axis and said lamps are located between said discharge coil and said lens, such that part of said lens is shielded from at least one of said lamps by said discharge coil.

9. The system of claim 7, wherein said discharge coil is generally centered on said longitudinal axis and said discharge coil is located between said lamps and said lens, said lamps being located above said discharge coil.

10. The system of claim 1, wherein said energy storage means comprises a plurality of series connected capacitors, said energy storage means having a B+ terminal and a ground reference terminal.

11. The system of claim 1, wherein said switch comprises an SCR means joining said one terminal of said energy storage means to said electrode means of said lamps and a timing oscillator circuit means for gating said SCR means.

12. The system of claim 1, wherein said lamps are xenon lamps.

13. The system of claim 1, wherein said HVDC means comprises:

a step up transformer having input terminals for receiving power supplied to the light fixture and having output terminals for an output voltage; and network means, connected to said output terminals of said transformer, for rectifying said output of said transformer to a pulsating DC voltage and for applying said DC voltage to filtering capacitor means.

14. The system of claim 13, wherein AC power is supplied to the base through an external junction box located near the base, and wherein said step up transformer is a toroidal transformer that is located in said box.

15. The system of claim 13, wherein said mounting means includes means for mounting said step up transformer.

16. The system of claim 1, wherein said load means produces at least 20,000 candela of light at the exterior of said Fresnel lens.

17. The system of claim 1, wherein the fixture comprises two generally cylindrical Fresnel lenses with one above the other, said mounting means fitting within one of said lenses and the other lens surrounding a red light emitting obstruction lamp.

18. The system of claim 1, further including:

second energy storage means for receiving, through said choke means, voltage from said HVDC means and capacitively storing energy therein across two terminals of which one is connected to said choke means;

switch means for switching said second energy storage means in parallel with said first energy storage means to apply added energy to said lamps, said switch means having an ON state and an OFF state; and voltage means for biasing said second energy storage means from the voltage applied to said first energy storage means when said switch means is in its OFF state.

19. The system of claim 18, further including means for sensing daylight and for operating said switch means to its ON state when daylight is sensed.

20. The system of claim 18, wherein said second energy storage means comprises electrolytic capacitors.

21. A capacitor discharge and strobe light beacon system for a 300 mm code incandescent tower light fixture of the type having a base to which 120 V AC power is supplied and a generally cylindrical high quality glass Fresnel lens which is hingedly attached to the base, comprising:

a step up transformer having input terminals for receiving a supply of current from the base of the light fixture and having high voltage output terminals;

network means, connected to said output terminals of said transformer, for rectifying said high voltage output of said transformer to a pulsating DC voltage, said network means including an output terminal for supplying an output voltage across capacitors connected thereto;

a choke which is connected to said output terminal of said network means;

means for producing light from at least two xenon discharge lamps which are connected to be operated redundantly and which are connected in series with said capacitors through said choke, each lamp having electrode means for discharging said capacitors through said lamps upon receiving a high voltage trigger signal;

circuit control means for operating a switch to apply high voltage to said electrode means of said lamps after said capacitor means has been charged for a predetermined time interval; and mounting means, fitting within the lens of the 300 mm code beacon incandescent light fixture, for mounting said step up transformer, said choke, said capacitors, said switch and said lamps, said lamps producing at least 20,000 candela of light at the exterior of the Fresnel lens, said mounting means including a mounting plate for removably positioning said lamps at the interior of the Fresnel lens.

22. A capacitor discharge and strobe light beacon system for a 300 mm code incandescent tower light fixture of the type having a base to which 120 V AC power is supplied and a generally cylindrical high quality glass Fresnel lens which is hingedly attached to the base, comprising:

a step up transformer having input terminals for receiving the power from the base of the light fixture and having output terminals for a high voltage output;

rectifying means, connected to said output terminals of said transformer, for full wave rectifying said output of said transformer to a pulsating DC voltage, said networking means including an output terminal for supplying an output voltage across filtering capacitors connected thereto;

night and day energy storage means for receiving high voltage, through a choke which is connected to said output terminal of said network means, and capacitively storing energy therein across two terminals of a plurality of series connected capacitors;

means for producing light from at least two xenon discharge lamps which are connected to be operated redundantly and connected across said series connected capacitors through a discharge coil, each lamp having electrode means for discharging said energy storage means through said lamps upon receiving a high voltage trigger signal;

circuit control means for applying line current to said input terminals of said step up transformer and for operating a switch to apply high voltage to said electrode means of said lamps from said energy storage means after said series connected capacitors have been charged for a predetermined time interval; and day energy storage means for receiving, through said choke, high voltage and capacitively storing energy therein across two terminals of a capacitor, one of said two terminals being connected to said choke;

switch means for switching said day energy storage means in parallel with said day and night energy storage means to apply added energy to said lamps during daylight, said switch means having an ON state and an OFF state;

means for sensing daylight and for operating said switch means to its ON state when daylight is sensed;

voltage means for biasing said second energy storage means from the voltage applied to said first energy storage means when said switch means is in its OFF state; and mounting means, fitting within the base of the 300 mm code beacon incandescent light fixture, for mounting, said discharge coil, said filtering capacitors, said night and day and said day energy storage means, said switch means and said switch, said mounting means including a mounting plate for removably positioning said lamps at the interior of said Fresnel lens and relatively above said discharge coil, said lamps being located on said mounting means at a position offset from the longitudinal axis of the lens and closer to said axis than said discharge coil.

23. A retrofitable capacitor discharge and strobe light beacon system, comprising:

a step-up transformer having input terminals for receiving a supply of alternating current and having output terminals for a high voltage output;

pulse shaping network means, connected to said output terminals of said transformer, for rectifying said output of said transformer to a pulsating DC voltage and supplying said pulsating DC voltage to one and an other output terminals thereof;

capacitor means having terminals connected to said one and said other output terminals of said pulse shaping network means;

flash choke means and trigger storage means which are connected together in series at an intermediate connection and connected in parallel with said filter capacitor means;

load means for producing a strobing light, said load means including at least a twin bank of xenon lamps which are connected to be operated redundantly and simultaneously, each bank having an anode terminal which is connected to said one terminal of said pulse shaping network means through said flasher choke, having a cathode terminal which is connected to said other terminal of said pulse shaping network means and having a triggering electrode;

timing oscillator circuit and switch means for providing a timing oscillator circuit and switching said triggering electrode to said intermediate connection after said capacitor means has been charged for a predetermined period of time, said timing oscillator circuit and switch means having an input terminal connected to said intermediate connection and having an output terminal; and mounting means for mounting, in a 300 MM code beacon incandescent light fixture, said step-up transformer, said pulse shaping network means, said capacitor means, said flash choke means, said trigger storage means, said timing oscillator and switch means, and said load means.

24. The apparatus of claim 23, wherein the twin bank xenon lamps comprises a ring of six xenon lamps to produce a non-directional flash of light through a high quality glass Fresnel lens sufficient to exceed a requirement of 20,000 candela of light.

25. A method of converting a 300 MM code incandescent light fixture into a capacitor discharge and strobe light beacon system, comprising the steps of:

opening the fixture and removing the existing red liner and incandescent lamp;

bypassing the flasher circuit for the incandescent lamp so that a continuous supply of line current is available;

connecting the input terminals of a step-up transformer to a supply of line current at the base of the light fixture to produce a high voltage at a pair of output terminals;

connecting said output to means for pulse shaping said high voltage into a rectified pulsating DC voltage;

connecting said rectified pulsating DC voltage to capacitor means;

connecting across said capacitor means flash choke means and trigger storage means which are connected together in series at an intermediate connection;

connecting to said choke means at least two lamps to be operated redundantly and simultaneously, each xenon lamp having an anode terminal, a cathode terminal and having a triggering electrode;

periodically connecting said intermediate connection to said triggering electrode by a switch; and housing together in an assembly said transformer, said pulse shaping network means, said capacitor means, said flash choke means, said trigger storage means, said switch and said lamps, said assembly being adapted to substantially fit within the lens of a 300 MM code incandescent light fixture.

* * * * *